US011705268B2

(12) United States Patent
Han et al.

(10) Patent No.: US 11,705,268 B2
(45) Date of Patent: Jul. 18, 2023

(54) COIL COMPONENT

(71) Applicant: SAMSUNG ELECTRO-MECHANICS CO., LTD., Suwon-si (KR)

(72) Inventors: Seung Ho Han, Suwon-si (KR); Sung Sik Shin, Suwon-si (KR); Jae Wook Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 915 days.

(21) Appl. No.: 16/567,520

(22) Filed: Sep. 11, 2019

(65) Prior Publication Data

US 2020/0286674 A1 Sep. 10, 2020

(30) Foreign Application Priority Data

Mar. 5, 2019 (KR) ..... 10-2019-0025074

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 41/04*** | (2006.01) |
| ***H01F 41/12*** | (2006.01) |
| ***H01F 27/32*** | (2006.01) |

(52) U.S. Cl.

CPC ..... *H01F 27/2804* (2013.01); *H01F 27/29* (2013.01); *H01F 27/323* (2013.01); *H01F 41/041* (2013.01); *H01F 41/122* (2013.01); *H01F 2027/2809* (2013.01)

(58) Field of Classification Search

CPC ..... H01F 27/2804
USPC ..... 336/200
See application file for complete search history.

(56) References Cited

U.S. PATENT DOCUMENTS

2009/0134956 A1* 5/2009 Hadano ..... H01F 17/0013 333/185
2013/0020914 A1* 1/2013 Tsukida ..... H01G 4/232 336/200
2013/0038979 A1* 2/2013 Togashi ..... H01G 4/30 361/301.4
2015/0380151 A1* 12/2015 Choi ..... H01F 41/041 336/200

(Continued)

FOREIGN PATENT DOCUMENTS

JP 2008-21752 A 1/2008
KR 10-2016-0108935 A 9/2016

*Primary Examiner* — Ronald Hinson
(74) *Attorney, Agent, or Firm* — Morgan, Lewis & Bockius LLP

(57) ABSTRACT

A coil component is provided. The coil component includes a body having one surface and the other surface, opposing each other, and a wall surface connecting the one surface and the other surface, a coil portion embedded in the body and having an end exposed to the wall surface of the body, an external electrode including a connecting portion disposed on the wall surface of the body and connected to the end of the coil portion, and an extension extending from the connecting portion onto the one surface of the body, a first insulating layer covering the other surface of the body, and an identification portion passing through the first insulating layer and including the same material as a material of the external electrode.

18 Claims, 6 Drawing Sheets

I–I'

(56) References Cited

U.S. PATENT DOCUMENTS

| | | | | |
|---|---|---|---|---|
| 2016/0086714 | A1* | 3/2016 | Moon | H01F 17/0013 336/200 |
| 2016/0268038 | A1* | 9/2016 | Choi | H01F 27/255 |
| 2018/0033546 | A1* | 2/2018 | Shin | H01F 27/2804 |
| 2018/0061551 | A1* | 3/2018 | Kondou | H01F 27/2804 |
| 2019/0115127 | A1* | 4/2019 | Iso | H01F 27/292 |

* cited by examiner

I–I'

II–II'

III-III'

I-I'

I-I'

COIL COMPONENT

CROSS-REFERENCE TO RELATED APPLICATION(S)

This application claims the benefit under 35 USC 119 (a) of Korean Patent Application No. 10-2019-0025074 filed on Mar. 5, 2019 in the Korean Intellectual Property Office, the entire disclosure of which is incorporated herein by reference for all purposes.

BACKGROUND

1. Field

The present disclosure relates to a coil component.

2. Description of Related Art

Inductors, which are coil components, are representative passive electronic components used in electronics along with resistors and capacitors.

The coil components may be provided with marking portions to identify mounting directions of the coil components on substrate such as printed circuit boards or the like.

Such a marking portion is identified using an identification device. In some cases, it may be difficult to identify the marking portion due to irregular reflection of light due to miniaturization of a coil component, surface roughness of the coil component or the like.

SUMMARY

An aspect of the present disclosure is to provide a coil component in which an identification portion may be easily identified.

According to an aspect of the present disclosure, a coil component includes a body having one surface and the other surface, opposing each other, and a wall surface connecting the one surface and the other surface, a coil portion embedded in the body and having an end exposed to the wall surface of the body, an external electrode including a connecting portion disposed on the wall surface of the body and connected to the end of the coil portion, and an extension extending from the connecting portion onto the one surface of the body, a first insulating layer covering the other surface of the body, and an identification portion passing through the first insulating layer and including the same material as a material of the external electrode.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
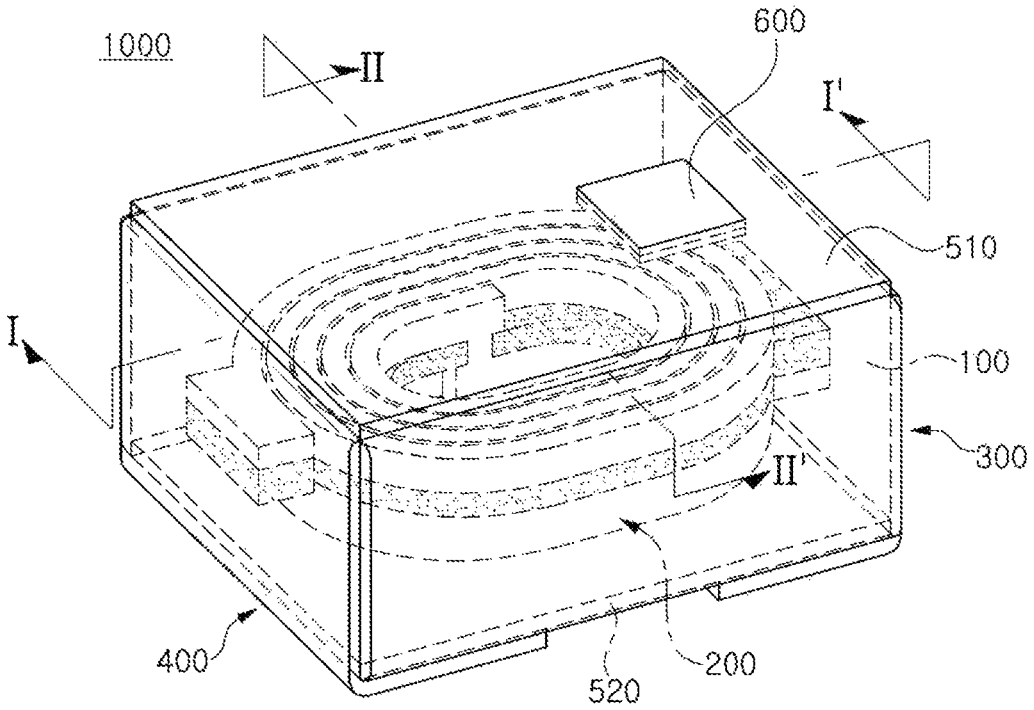
FIG. 1 is a perspective view schematically illustrating a coil component according to a first embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed, as will be apparent to one of ordinary skill in the art, with the exception of operations necessarily occurring in a certain order. Also, descriptions of functions and constructions that would be well known to one of ordinary skill in the art may be omitted for increased clarity and conciseness.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "including", "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Throughout the specification, it will be understood that when an element, such as a layer, region or wafer (substrate), is referred to as being "on," "connected to," or "coupled to" another element, it may be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

In addition, the term "coupled" is used not only in the case of direct physical contact between the respective constituent elements in the contact relation between the constituent elements, but also in the case in which other constituent elements are interposed between the constituent elements such that they are in respective contact with each other, being used as a comprehensive concept.

The drawings may not be to scale, and the relative size, proportions, and depictions of elements in the drawings may be exaggerated for clarity, illustration, and convenience.

In the drawing, the L direction may be defined as a first direction or a length direction, the W direction as a second direction or a width direction, and the T direction as a third direction or a thickness direction.

Hereinafter, a coil component according to an embodiment in the present disclosure will be described in detail with reference to the accompanying drawings. Referring to the accompanying drawings, the same or corresponding components are denoted by the same reference numerals, and redundant descriptions thereof will be omitted.

Various types of electronic components are used in electronic devices. Various types of coil components may be suitably used for noise removal or the like between these electronic components.

For example, as a coil component in an electronic device, a power inductor, a high frequency inductor (HF Inductor), a general bead, a bead for high frequency (GHz Bead), a common mode filter, or the like may be used.

First Embodiment

Figure 2:
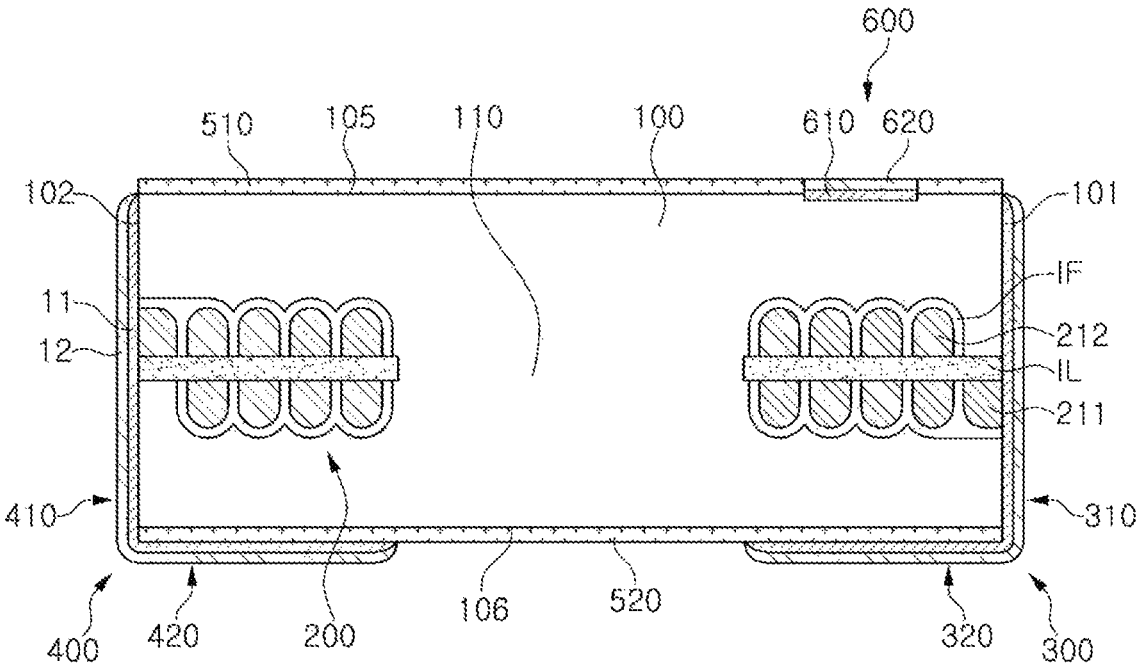
FIG. 2 is a cross-sectional view taken along line I-I' in FIG. 1.
Figure 3:
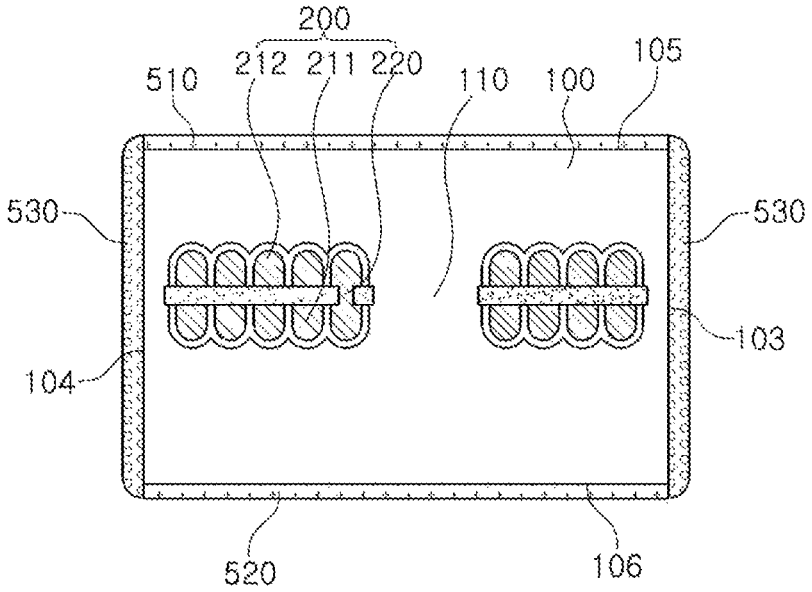
FIG. 3 is a cross-sectional view taken along line II-II' in FIG. 1.
Figure 4A:
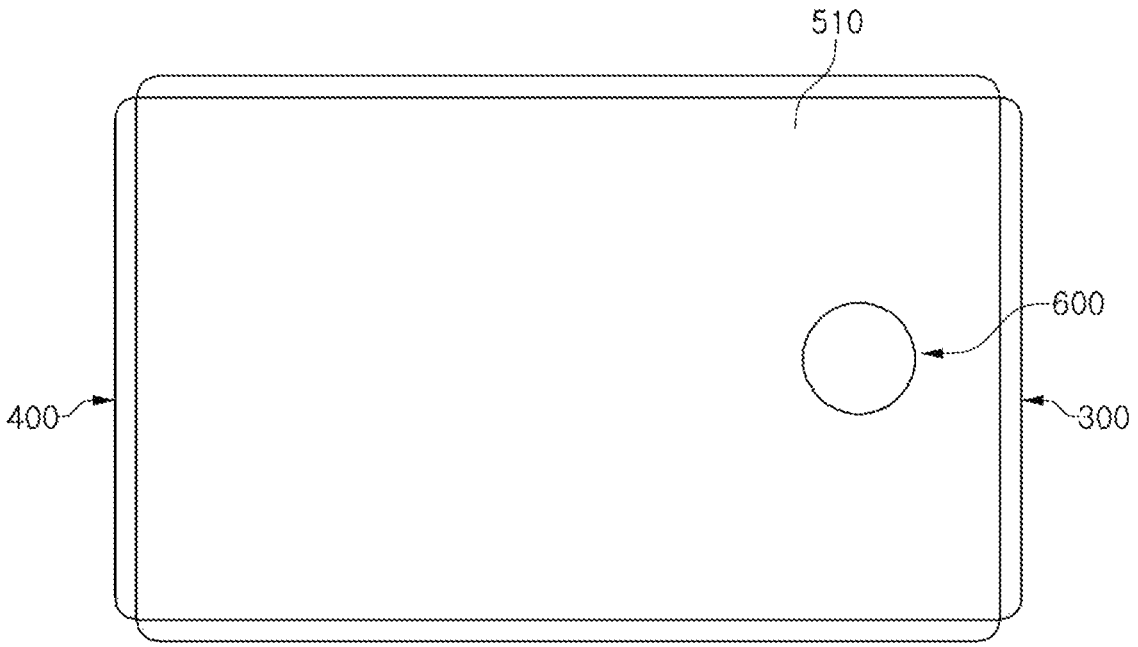
FIG. 4A and FIG. 4B are views illustrating a modified example of an identification portion.
Figure 4B:
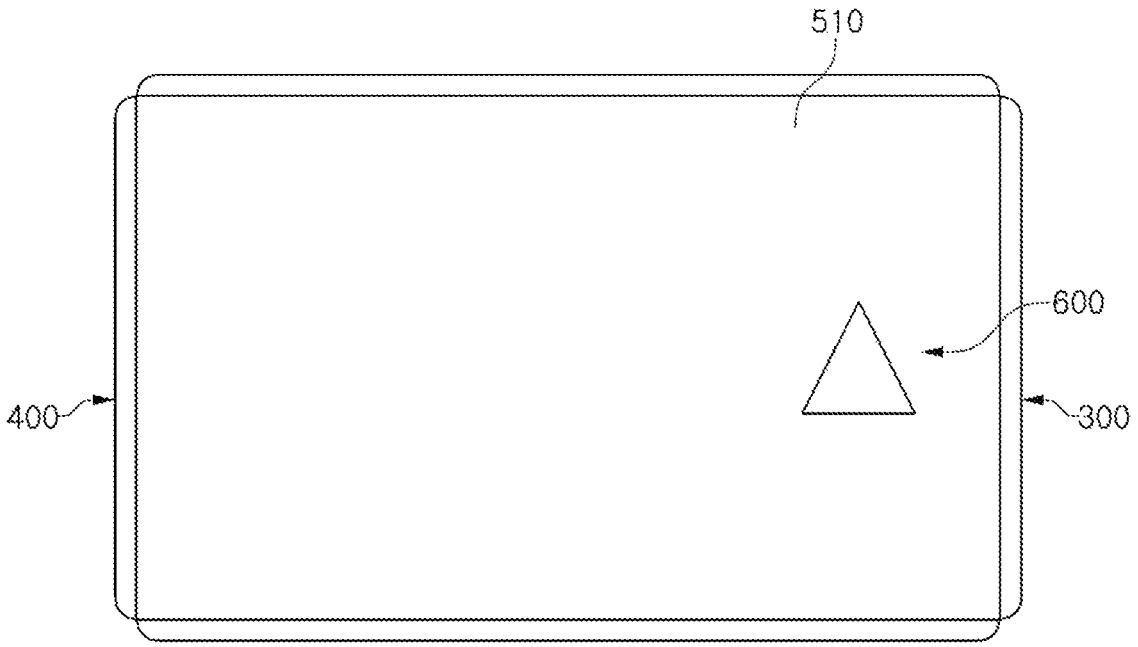

FIG. 1 is a perspective view schematically illustrating a coil component according to a first embodiment. FIG. 2 is a cross-sectional view taken along line I-I' in FIG. 1. FIG. 3 is a cross-sectional view taken along line II-II' in FIG. 1. FIG. 4A and FIG. 4B are views illustrating a modified example of an identification portion.

Referring to FIGS. 1 to 4B, a coil component 1000 according to an embodiment may include a body 100, a coil portion 200, first and second external electrodes 300 and 400, a first insulating layer 510, and an identification portion 600, and may further include an internal insulating layer IL, a second insulating layer 520, and an insulating film IF.

The body 100 forms the appearance of the coil component 1000 according to the embodiment. The body 100 may be formed to have a hexahedral shape as a whole.

Hereinafter, an embodiment in the present disclosure will be described with reference to a case in which the body 100 has a hexahedral shape by way of example. However, these descriptions do not exclude coil components that include bodies formed to have shapes other than hexahedral, within the scope of the present disclosure.

Referring to FIGS. 2 and 3, the body 100 has a first surface 101 and a second surface 102 opposing each other in a length direction L, a third surface 103 and a fourth surface 104 opposing each other in a width direction W, and a fifth surface 105 and a sixth surface 106 opposing in a thickness direction T. Each of the first to fourth surfaces 101, 102, 103 and 104 of the body 100 corresponds to a wall surface of the body 100, connecting the fifth surface 105 and the sixth surface 106 of the body 100 to each other. In the following description, both opposing end surfaces of the body 100 among a plurality of wall surfaces thereof refer to the first surface 101 and the second surface 102 of the body 100, and both opposing side surfaces of the body 100 among the plurality of wall surfaces thereof may refer to the third surface 103 and the fourth surface 104 of the body 100.

The body 100 may be formed, in such a manner that, the coil component 1000 according to an embodiment, including first and second external electrodes 300 and 400, respectively, a first insulating layer 510 and a second insulating layer 520, to be described later, may be formed to have a length of 2.0 mm, a width of 1.2 mm, and a thickness of 0.65 mm, but an embodiment thereof is not limited thereto. On the other hand, since the above-described numerical values do not take process errors into account, numerical values different from the above-mentioned numerical values, due to process errors, may also be within the scope of the present disclosure.

The body 100 may include a magnetic material and a resin. In detail, the body 100 may be formed by laminating one or more magnetic composite sheets including a resin and a magnetic material dispersed in the resin. In addition, the body 100 may also have a structure in addition to the structure in which the magnetic material is dispersed in the resin. For example, the body 100 may be formed of a magnetic material such as ferrite.

The magnetic material may be ferrite or a magnetic metal powder.

The ferrite powder may be one or more of spinel type ferrite such as Mg—Zn type, Mn—Zn type, Mn—Mg type, Cu—Zn type, Mg—Mn—Sr type, Ni—Zn type or the like, hexagonal ferrite such as Ba—Zn, Ba—Mg, Ba—Ni, Ba—Co, Ba—Ni—Co type, or the like, garnet type ferrite such as Y type or the like, and Li-based ferrite.

The magnetic metal powder may include one or more elements selected from the group consisting of iron (Fe), silicon (Si), chromium (Cr), cobalt (Co), molybdenum (Mo), aluminum (Al), niobium (Nb), copper (Cu) and nickel (Ni). For example, the magnetic metal powder may include at least one or more powders selected from the group consisting of pure iron powder, Fe—Si alloy powder, Fe—Si—Al alloy powder, Fe—Ni alloy powder, Fe—Ni—Mo alloy powder, Fe—Ni—Mo—Cu alloy powder, Fe—Co alloy powder, Fe—Ni—Co alloy powder, Fe—Cr alloy powder, Fe—Cr—Si alloy powder, Fe—Si—Cu—Nb alloy powder, Fe—Ni—Cr alloy powder, and Fe—Cr—Al alloy powder.

The magnetic metal powder may be amorphous or crystalline. For example, the magnetic metal powder may be an Fe—Si—B—Cr amorphous alloy powder, but is not limited thereto.

The ferrite and the magnetic metal powder may have an average diameter of about 0.1 μm to 30 μm, respectively, but embodiments thereof are not limited thereto.

The body 100 may include two or more kinds of magnetic materials dispersed in a resin. In this case, the term "different kinds of magnetic materials" means that the magnetic materials dispersed in the resin are distinguished from each other by at least one of an average diameter, a composition, crystallinity and a shape.

The resin may include, but is not limited to, an epoxy, polyimide, a liquid crystal polymer, or the like, alone or in combination.

The body 100 includes the coil portion 200 and a core 110 passing through an internal insulating layer IL, to be described later. The core 110 may be formed by filling a through hole of the coil portion 200 with a magnetic composite sheet, but an embodiment thereof is not limited thereto.

The coil portion 200 is embedded in the body 100 to exhibit characteristics of a coil component. For example, when the coil component 1000 according to the embodiment is used as a power inductor, the coil portion 200 may function to stabilize the power supply of an electronic device by storing an electric field as a magnetic field and maintaining an output voltage. Both ends of the coil portion 200 may be exposed to the first and second surfaces 101 and 102 of the body 100.

The coil portion 200 applied to this embodiment includes a first coil pattern 211, a second coil pattern 212, and a via 220.

The first coil pattern 211, the internal insulating layer IL and the second coil pattern 212 to be described later may be sequentially laminated in a thickness direction T of the body 100.

Each of the first coil pattern 211 and the second coil pattern 212 may be formed to have a planar spiral shape. As an example, the first coil pattern 211 may include at least one turn about the core 110 of the body 100 on one surface of the internal insulating layer IL (a lower surface of IL in FIG. 2). The second coil pattern 212 may include at least one turn about the core 110 of the body 100 on the other surface of the internal insulating layer IL (an upper surface of IL in FIG. 2). The first and second coil patterns 211 and 212 may be wound in the same direction.

The via 220 penetrates through the internal insulating layer IL to electrically connect the first coil pattern 211 and the second coil pattern 212 to each other, to respectively be in contact with the first coil pattern 211 and the second coil pattern 212. As a result, the coil portion 200 according to the embodiment may be formed as a single coil that generates a magnetic field in the thickness direction T of the body 100 in the body 100.

At least one of the first coil pattern 211, the second coil pattern 212, and the via 220 may include at least one conductive layer.

As an example, in the case in which the second coil pattern 212 and the vias 220 are formed by a plating method, the second coil pattern 212 and the via 220 may each include a seed layer and an electroplating layer. The seed layer may be formed by an electroless plating method or a vapor deposition method such as sputtering or the like. The electroplating layer may have a single-layer structure or a multi-layer structure. The electroplating layer of the multi-layer structure may be formed to have a conformal film structure in which one electroplating layer is covered by another electroplating layer, and may also be formed to have a form in which only on one surface of one electroplating layer, another electroplating layer is laminated. A seed layer of the second coil pattern 212 and a seed layer of the via 220 may be integrally formed without a boundary being formed therebetween, but an embodiment thereof is not limited thereto. The electroplated layer of the second coil pattern 212 and the electroplated layer of the via 220 may be integrally formed without a boundary being formed therebetween, but an embodiment thereof is not limited thereto.

As another example, in a case in which the first coil pattern 211 and the second coil pattern 212 are separately formed and then laminated together on the internal insulating layer IL to form the coil portion 200, the via 220 may include a high melting point metal layer and a low melting point metal layer having a melting point lower than that of the high melting point metal layer. In this case, the low melting point metal layer may be formed of a solder containing tin (Sn). The low melting point metal layer is at least partially melted due to pressure and temperature at the time of lamination, in such a manner that an intermetallic compound layer (IMC layer) may be formed to have at least one of interfaces between the low melting point metal layer and the first coil pattern 211, between the low melting point metal layer and the second coil pattern 212, and between the high melting point metal layer and the low melting point metal layer.

In an example referring to FIG. 2, the first coil pattern 211 and the second coil pattern 212 may protrude from a lower surface and an upper surface of the internal insulating layer IL, respectively. In another example with reference to FIG. 2, the first coil pattern 211 may be embedded in the lower surface of the internal insulating layer IL in such a manner that a lower surface thereof is exposed to the lower surface of the internal insulating layer IL, and the second coil pattern 212 may be exposed to an upper surface of the internal insulating layer IL. In this case, a concave portion is formed in the lower surface of the first coil pattern 211, such that the lower surface of the internal insulating layer IL and the lower surface of the first coil pattern 211 may not be located on the same plane. As another examples with reference to FIG. 2, the first coil pattern 211 may be embedded in the lower surface of the internal insulating layer IL in such a manner that the lower surface thereof is exposed to the lower surface of the internal insulating layer IL, and the second coil pattern 212 may be embedded in the upper surface of the internal insulating layer IL in such a manner that an upper surface thereof may be exposed to the upper surface of the internal insulating layer IL.

Ends of the first coil pattern 211 and the second coil pattern 212 may be exposed to the first and second surfaces 101 and 102 of the body 100, respectively. An end of the first coil pattern 211 exposed to the first surface 101 of the body 100 contacts a first external electrode 300 to be described later, to be electrically connected to the first external electrode 300. An end of the second coil pattern 212 exposed to the second surface 102 of the body 100 contacts a second external electrode 400 to be described later, to be electrically connected to the second external electrode 400.

The first coil pattern 211, the second coil pattern 212 and the vias 220 may respectively be formed of a conductive material, such as copper (Cu), aluminum (Al), silver (Ag), tin (Sn), gold (Au), nickel (Ni), lead (Pb), titanium (Ti), alloys thereof, or the like, but a material thereof is not limited thereto.

The first and second coil patterns 211 and 212 are formed on both surfaces of the internal insulating layer IL, respectively. For example, the internal insulating layer IL supports the first and second coil patterns 211 and 212.

The internal insulating layer IL may be formed of an insulating material including a thermosetting insulating resin such as an epoxy resin, a thermoplastic insulating resin such as polyimide, or a photoimageable dielectric resin, or an insulating material in which a reinforcing material such as glass fiber or inorganic filler is impregnated with these insulating resins. For example, the internal insulating layer IL may be formed of an insulating material such as a prepreg, an Ajinomoto Build-up Film (ABF), an FR-4, a Bismaleimide Triazine (BT) resin, or photoimageable dielectric (PID), but an embodiment thereof is not limited thereto.

The inorganic filler may be one or more compounds selected from the group consisting of silica ($SiO_2$), alumina ($Al_2O_3$), silicon carbide (SiC), barium sulphate ($BaSO_4$), talc, mud, mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$) and calcium zirconate ($CaZrO_3$).

In the case in which the internal insulating layer IL is formed of an insulating material including a reinforcing material, the internal insulating layer IL may provide relatively better rigidity. In the case in which the internal insulating layer IL is formed of an insulating material not containing a glass fiber, the internal insulating layer IL may be advantageous in terms of thinning an overall thickness of the coil component 1000 according to the embodiment. In the case in which the internal insulating layer IL is formed of an insulating material containing a photoimageable dielectric resin, the number of processes is reduced, which may be advantageous in terms of reducing production costs and fine hole processing.

The first and second external electrodes 300 and 400 are spaced apart from each other on the sixth surface 106 of the body 100, and are respectively connected to the coil portion 200. The first external electrode 300 includes a first connection portion 310 disposed on the first surface 101 of the body 100 and connected to an end of the first coil pattern 211, and a first extension 320 extending from the first connection portion 310 onto the sixth surface 106 of the body 100. The second external electrode 400 includes a second connection portion 410 disposed on the second surface 102 of the body 100 and connected to an end of the second coil pattern 212, and a second extension 420 extending from the second connection portion 410 onto the sixth surface 106 of the body 100. The first extension 320 and the second extension 420 disposed on the sixth surface 106 of the body 100 are spaced apart from each other to prevent a short between the first external electrode 300 and the second external electrode 400. In this embodiment, since the second insulating layer 520 to be described later is disposed on the entirety of the sixth surface 106 of the body 100, the first and second extensions 320 and 420 of the first and second external electrodes 300 and 400 extend onto the second insulating layer 520, to be spaced apart from each other on the second insulating layer 520.

The first and second external electrodes 300 and 400 electrically connect the coil component 1000 to a printed circuit board or the like when the coil component 1000 according to an embodiment is mounted on the printed circuit board or the like. As an example, the coil component 1000 according to the embodiment may be mounted after the sixth surface 106 of the body 100 is disposed to face the printed circuit board. Therefore, the coil component 1000 according to the embodiment may be easily connected to a printed circuit board or the like due to the first and second extensions 320 and 420 together disposed on the sixth surface 106 of the body 100.

Each of the first and second external electrodes 300 and 400 may include at least one electroplating layer. Each of the external electrodes 300 and 400 in this embodiment includes a first electrode layer 11 disposed on a surface of the body 100, and a second electrode layer 12 disposed on the first electrode layer 11. The first electrode layer 11 may be formed through a first electroplating process using a first electrolytic plating solution, and the second electrode layer 12 may be formed through a second electroplating process using a second electrolytic plating solution. The first electrolytic plating solution may contain copper (Cu) ions, and the second electrolytic plating solution may include nickel (Ni) ions. As a result, the first electrode layer 11 and the second electrode layer 12 sequentially formed through the first and second electroplating processes may each include copper (Cu) and nickel (Ni). On the other hand, the second electrode layer 12 may have a structure of a plurality of layers. For example, the second electrode layer 12 may be formed to have a multilayer structure comprised of a nickel-plated layer containing nickel (Ni) and a tin plating layer disposed on the nickel plated layer and containing tin (Sn). In this case, the second electrode layer 12 may be formed by sequentially exposing the body 100 having the first electrode layer 11 to the second electrolytic solution containing nickel (Ni) ions and a third electrolytic solution containing tin (Sn) ions.

The first insulating layer 510 is disposed on the fifth surface 105 of the body 100 to cover the fifth surface 105 of the body 100. The first insulating layer 510 may be formed by laminating an insulating film on the fifth surface 105 of the body 100 or by applying an insulating paste to the fifth surface 105 of the body 100.

The first insulating layer 510 may include a thermoplastic resin such as a polystyrene type, a vinyl acetate type, a polyester type, a polyethylene type, a polypropylene type, a polyamide type, a rubber, acrylic resin or the like, a thermosetting resin such as phenol-based, epoxy-based, urethane-based, melamine-based, alkyd-based resin or the like, a photoimageable resin, or an insulating resin such as parylene.

The first insulating layer 510 may further include a filler dispersed in the above-described insulating resin. The filler may be an inorganic filler or an organic filler, a powder phase of an insulating resin. The inorganic filler may be one or more selected from the group consisting of silica ($SiO_2$), alumina ($Al_2O_3$), silicon carbide (SiC), barium sulphate ($BaSO_4$), talc, mud, mica powder, aluminum hydroxide ($AlOH_3$), magnesium hydroxide ($Mg(OH)_2$), calcium carbonate($CaCO_3$), magnesium carbonate ($MgCO_3$), magnesium oxide (MgO), boron nitride (BN), aluminum borate ($AlBO_3$), barium titanate ($BaTiO_3$) and calcium zirconate ($CaZrO_3$).

A side surface of the first insulating layer 510 and at least one of the first to fourth surfaces 101, 102, 103 and 104 of the body 100 may be disposed on substantially the same plane. The coil component 1000 according to this embodiment may be manufactured by manufacturing a coil substrate having a plurality of bodies connected to each other, separating the plurality of bodies along a dicing line of the coil substrate, and then forming external electrodes on surfaces of the respective bodies. The first insulating layer 510 and the second insulating layer 520 to be described later may be disposed on both surfaces of the coil substrate before the dicing process, respectively. Therefore, when the dicing process is performed thereafter, a side surface of the first insulating layer 510 and the first to fourth surfaces 101, 102, 103 and 104 of the body 100 in each separated body correspond to cut surfaces, and may thus be disposed on substantially the same plane.

The identification portion 600 may be formed for identifying a mounting direction and the like when the coil component 1000 according to the embodiment is mounted on a printed circuit board or the like.

The identification portion 600 penetrates through the first insulating layer 510 and includes the same material as that of the first and second external electrodes 300 and 400. In detail, in a process of forming the first and second external electrodes 300 and 400, the identification portion 600 and the first and second external electrodes 300 and 400 are formed together. As a result, the identification portion 600 may include the same material as that of the first and second external electrodes 300 and 400. In the case in which the first and second external electrodes 300 and 400 are formed to have a multilayer structure including the first electrode layer 11 and the second electrode layer 12, respectively, the identification portion 600 is also formed to have a multilayer structure including a first pattern layer 610 and a second pattern layer 620. For example, the first electrode layer 11 and the first pattern layer 610 are formed together in the first electroplating process, and may thus include the same material. In addition, the second electrode layer 12 and the second pattern layer 620 are formed together in the second electroplating process, and may thus include the same material. As an example, the first electrode layer 11 and the first pattern layer 610 may include copper (Cu), and the second electrode layer 12 and the second pattern layer 620 may include nickel (Ni). In one embodiment, the second electrode layer 12 and the second pattern layer 620 may include a nickel-plated layer containing nickel (Ni) and a tin plating layer disposed on the nickel plated layer and containing tin (Sn).

The identification portion 600 may be formed by forming the first insulating layer 510 on the fifth surface 105 of the body 100, forming an opening, exposing the fifth surface 105 of the body 100, in the first insulating layer 510, and then forming a conductive material in the opening through the above-described electrolytic plating process. The opening of the first insulating layer 510 may be formed by irradiating a laser to the first insulating layer 510. In this case, a portion of the fifth surface 105 side of the body 100 exposed through the opening is removed together with the first insulating layer 510 by a laser, such that a groove may be formed in the fifth surface 105 of the body 100. In this case, the identification portion 600 may be formed in such a manner that the identification portion 600 passes through the first insulation layer 510, and at least a portion of the identification portion 600 extends to the inside of the body 100.

Therefore, the identification portion 600 is exposed to the other surface (an upper surface with reference to FIG. 2) of the first insulating layer 510, opposing one surface (a lower surface with reference to FIG. 2) of the first insulating layer 510, in contact with the body 100. An exposed surface of the identification portion 600 may not be disposed on the same plane as the other surface of the first insulating layer 510, depending on plating conditions and the size of the opening of the first insulating layer 510. When the exposed surface of the identification portion 600 and the other surface of the first insulating layer 510 are not disposed on the same plane, the identification portion 600 may be more easily recognized by a height difference between the first insulating layer 510 and the identification portion 600 using an identification device. For example, since a path difference of light irradiated by the identification device is caused, the recognition of the identification portion 600 may be relatively further facilitated.

The identification portion 600 may be modified to have various forms as illustrated in FIGS. 4A and 4B. For example, the identification portion 600 may be formed to have a quadrangular shape as illustrated in FIG. 1 or the like, and may be formed to have a circular or triangular shape as illustrated in FIGS. 4A and 4B. The shapes of the identification portion 600 illustrated in FIGS. 1, 4A and 4B are merely illustrative, and thus the scope of the present disclosure is not limited thereto.

Since the body 100 and the first insulating layer 510 are formed of a material including a curable resin, surface roughness is formed due to shrinkage and expansion during curing. Therefore, light of the identification device that identifies an identification mark of the electronic component is irregularly reflected due to the surface roughness of the body 100 and the first insulating layer 510. As a result, in this case, the recognition of the identification mark is not facilitated. On the other hand, in the case of this embodiment in the present disclosure, since the identification portion 600 is formed by electrolplating, the identification portion 600 may be identified more easily by the identification device. For example, since a surface of the identification portion has a significantly lower surface roughness value than the surface roughness of the body portion in terms of plating layer characteristics, the light of the identification device is prevented from being irregularly reflecting on the surface of the identification portion.

The second insulating layer 520 may be disposed on the sixth surface 106 of the body 100. The second insulating layer 520 may be formed by laminating an insulating film on the sixth surface 106 of the body 100 or by applying an insulating paste to the sixth surface 106 of the body 100. A side surface of the second insulating layer 520 and at least one of the first to fourth surfaces 101, 102, 103 and 104 of the body 100 may be disposed on substantially the same plane.

As described in FIG. 3, one or more third insulating layer 530 may be disposed on the third and fourth surfaces 103 and 104 of the body 100. The third insulating layer 530 may be formed on the third and fourth surfaces 103 and 104 of each body 100 after the dicing process described above is performed. The third insulating layer 530 may be formed of an insulating film including an insulating resin, or may be formed of an insulating paste including an insulating resin. The third insulating layer 530 may include a photoimageable dielectric resin.

In forming the first and second external electrodes 300 and 400 on the first and second surfaces 101 and 102 of the body 100 by a plating process, the third insulating layer 530 may be used as a plating resist, together with the first and second insulating layers 510 and 520. Thus, the third insulating layer 530 may be formed on the first and second surfaces 101 and 102 of the body 100 as well as on the third and fourth surfaces 103 and 104 of the body 100. In this case, in regions of the third insulating layer 530, disposed on the first and second surfaces 101 and 102 of the body 100, openings may be formed to correspond to the first and second connection portions 310 and 410 of the first and second external electrodes 300 and 400, respectively, while exposing both ends of the coil portion 200 exposed to the first and second surfaces 101 and 102 of the body 100.

The insulating film IF may be formed along the surfaces of the first coil pattern 211, the internal insulating layer IL, and the second coil pattern 212. The insulating film IF protects and insulates the respective coil patterns 211 and 212, and includes a known insulating material such as parylene. Any insulating materials may be used for the insulating film IF without particular limitations. The insulating film IF may be formed by vapor deposition or the like, but an embodiment thereof is not limited thereto. For example, the insulating film IF may be formed by forming an insulating material such as an insulating film on both surfaces of the internal insulating layer IL on which the first and second coil patterns 211 and 212 are formed. The above-described insulating film IF may be omitted in this embodiment depending on design requirements or the like.

Although not illustrated in the drawings, at least one of the first coil pattern 211 and the second coil pattern 212 may be formed of a plurality of layers. As an example, the coil portion 200 may have a structure in which a plurality of first coil patterns 211 are formed, in detail, one of the first coil patterns is laminated on another first coil pattern. In this case, an additional insulating layer may be disposed between the plurality of first coil patterns 211, and a connecting via may be formed in the additional insulating layer to penetrate therethrough, to connect the adjacent first coil patterns to each other.

Second Embodiment

Figure 5:
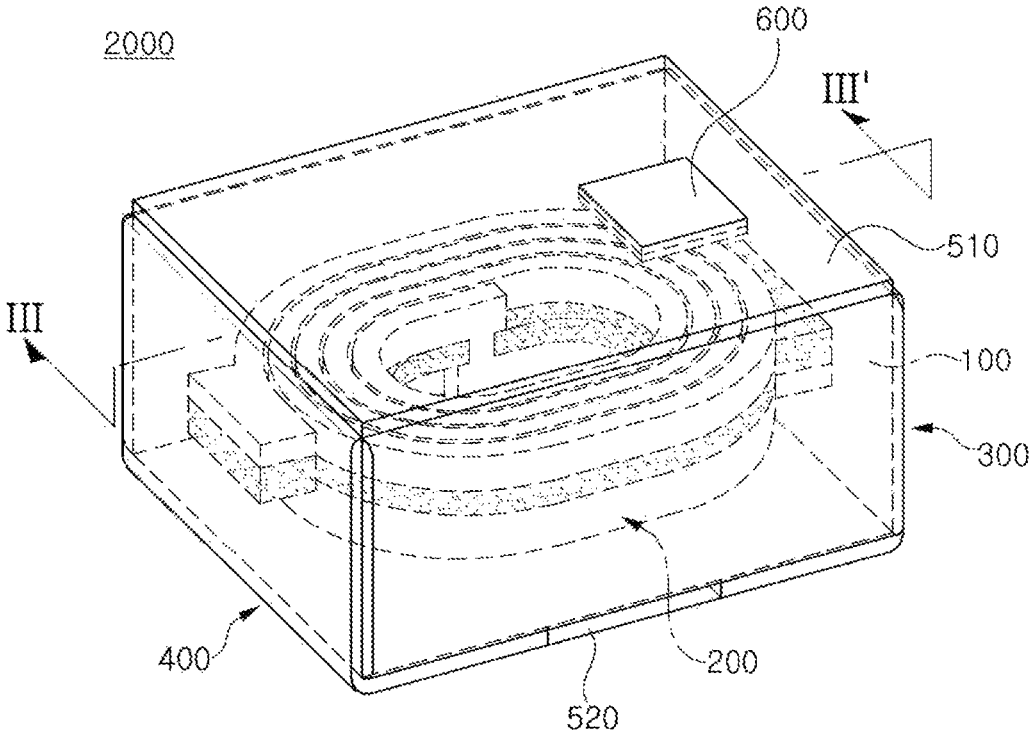
FIG. 5 is a perspective view schematically illustrating a coil component according to a second embodiment.
Figure 6:
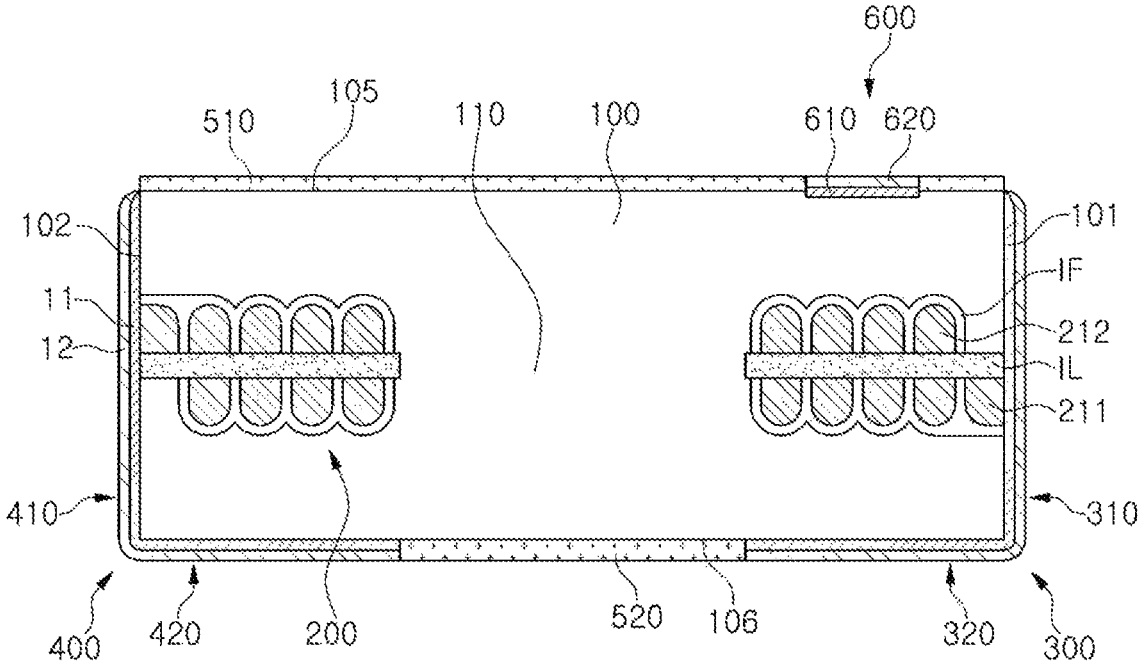
FIG. 6 is a cross-sectional view taken along line in FIG. 5.

FIG. 5 is a perspective view schematically illustrating a coil component 2000 according to a second embodiment. FIG. 6 is a cross-sectional view taken along line in FIG. 5.

Referring to FIGS. 1 to 6, a coil component 2000 according to the embodiment differs from the coil component 1000 according to the first embodiment, in that a second insulating layer 520 is different from that in the first embodiment. Therefore, in describing this embodiment, only the second insulating layer 620 will be described. For the remaining configurations according to the embodiment, the above description of the first embodiment may be applied thereto as it is.

Referring to FIGS. 5 and 6, an opening pattern corresponding to the first and second extensions 320 and 420 is formed in the second insulating layer 520 applied to the present embodiment. The opening pattern may be formed by forming the second insulating layer 620 on the sixth surface 106 of the body 100 and then selectively removing a region corresponding to a region of formation of the extensions 320 and 420 from the second insulating layer 520. In the case in which the second insulating layer 520 includes a photoimageable dielectric resin, the opening pattern may be formed through a photolithography process.

Therefore, the first and second extensions 320 and 420 of the first and second external electrodes 300 and 400 may directly contact the sixth surface 106 of the body 100. As a result, a thickness of the coil component 2000 according to the embodiment may be reduced.

Third Embodiment

Figure 7:
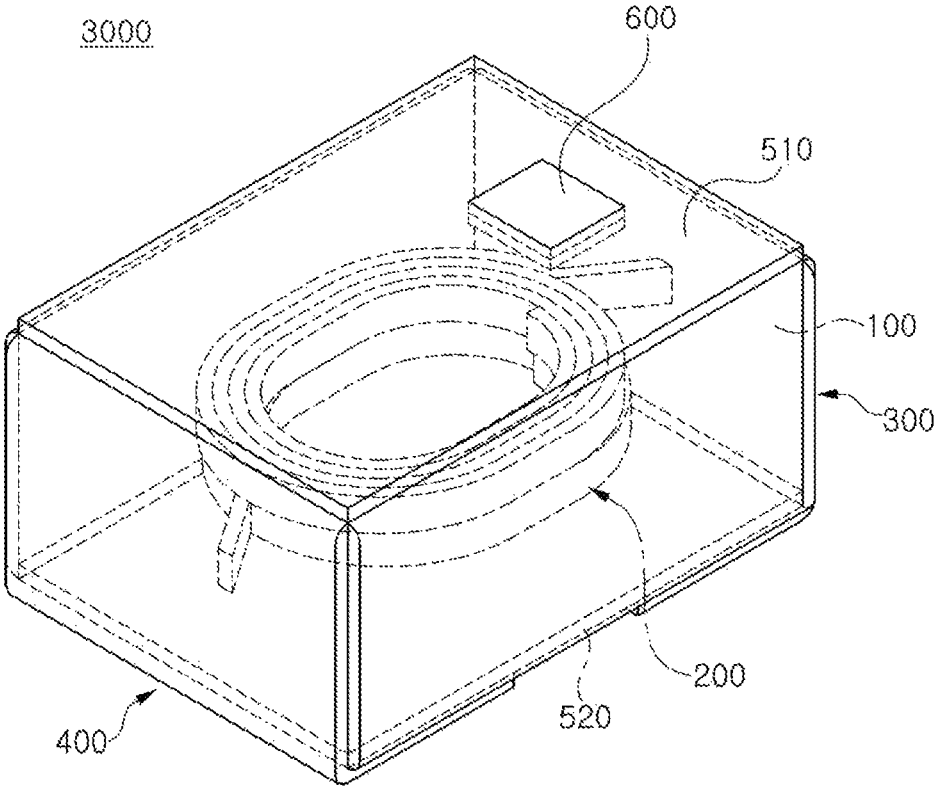
FIG. 7 is a perspective view schematically illustrating a coil component according to a third embodiment.
Figure 8:
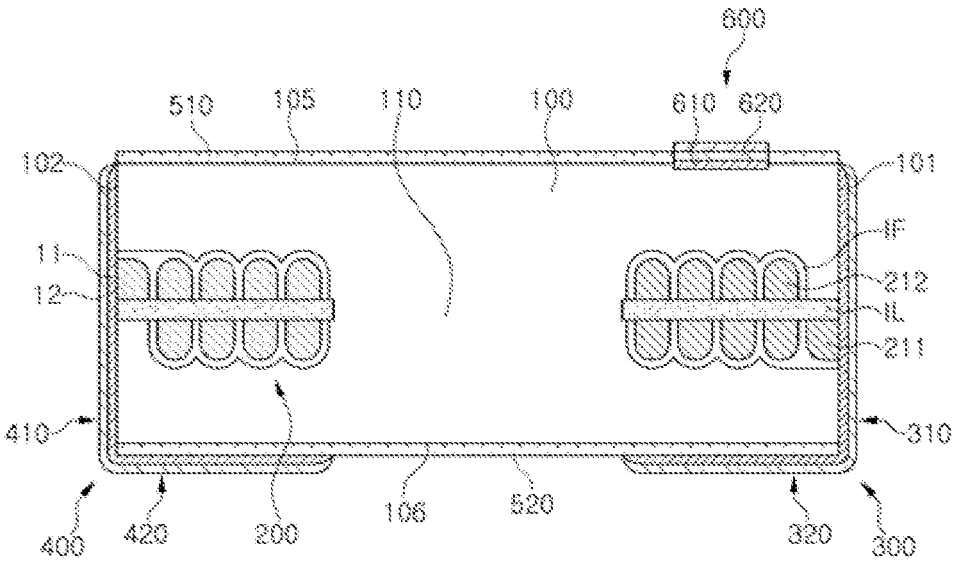
FIG. 8 is a perspective view schematically illustrating a coil component having the other surface of the first insulating layer and the other surface of the identification portion are located at different height, and a Cu—Ni—Sn three layer structure having a first pattern layer comprising a copper (Cu), a second pattern layer comprising nickel (Ni), and a third pattern layer comprising tin (Sn)
Figure 9:
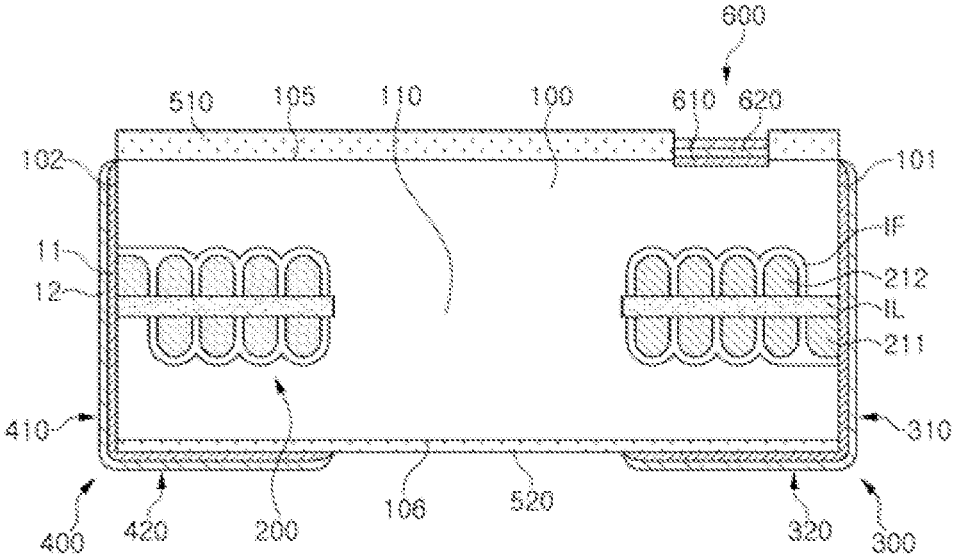
FIG. 9 is a perspective view schematically illustrating a coil component having the other surface of the first insulating layer and the other surface of the identification portion are located at different height, and a Cu—Ni—Sn three layer structure having a first pattern layer comprising a copper (Cu), a second pattern layer comprising nickel (Ni), and a third pattern layer comprising tin (Sn).

FIG. 7 is a perspective view schematically illustrating a coil component 3000 according to a third embodiment.

Referring to FIGS. 1 to 4 and 7, a coil component 3000 according to the embodiment has a coil portion 200 different from those of the first and second embodiments as compared with the coil components 1000 and 2000 according to the first and second embodiments. Therefore, in describing this embodiment, only the coil portion 200 will be described. For the remaining configurations of the embodiment, the above descriptions of the first and second embodiments may be applied thereto as is.

Referring to FIG. 7, the coil portion 200 applied to this embodiment may be a wire-wound coil.

The coil portion 200 is an air-core coil, and may be constituted by a rectangular coil. The coil portion 200 may be formed by spirally winding a metal wire such as a copper (Cu) wire or the like of which a surface is coated with an insulating material.

The coil portion 200 may be comprised of a plurality of layers. Each layer of the coil portion 200 is formed to have a flat spiral shape and may have a plurality of turn numbers.

In the case of this embodiment, by using a wire-wound coil formed of a metal wire as the coil portion 200, the coil component may be manufactured by a simpler method.

As set forth above, according to an embodiment, an identification portion may be identified relatively easily.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed to have a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A coil component comprising:

a body having one surface and the other surface, opposing each other, and a wall surface connecting the one surface and the other surface;

a coil portion embedded in the body and having an end exposed to the wall surface of the body;

an external electrode including a connecting portion disposed on the wall surface of the body and connected to the end of the coil portion, and an extension extending from the connecting portion onto the one surface of the body;

a first insulating layer covering the other surface of the body; and an identification portion penetrating through the first insulating layer and including the same material as a material of the external electrode wherein each of the first insulating layer and the identification portion has one surface contacting the body and the other surface opposing the one surface, the one surface of the first insulating layer and the one surface of the identification portion are not located on the same plane, and the one surface of the identification layer protrudes into the body more than the one surface of the insulating layer.

2. The coil component of claim 1, wherein the external electrode and the identification portion comprise copper (Cu).

3. The coil component of claim 1, wherein the other surface of the first insulating layer and the other surface of the identification portion are located at different heights.

4. The coil component of claim 1, wherein the external electrode comprises a first electrode layer in contact with the body, and a second electrode layer disposed on the first electrode layer, and the identification portion comprises a first pattern layer in contact with the body, the first pattern layer including the same material as a material of the first electrode layer, and a second pattern layer disposed on the first pattern layer and including the same material as a material of the second electrode layer.

5. The coil component of claim 4, wherein the first electrode layer and the first pattern layer comprise copper (Cu).

6. The coil component of claim 4, wherein the second electrode layer and the second pattern layer comprise nickel (Ni).

7. The coil component of claim 1, further comprising:

an internal insulating layer embedded in the body, wherein the coil portion is disposed on at least one surface of the internal insulating layer.

8. The coil component of claim 1, wherein the coil portion is a wound coil.

9. The coil component of claim 1, further comprising a second insulating layer disposed on one surface of the body, the second insulating layer having an opening pattern on which the extension is not disposed.

10. The coil component of claim 1, wherein the identification portion has a quadrangular shape.

11. The coil component of claim 1, wherein the identification portion has a circular or triangular shape.

12. The coil component of claim 1, wherein a surface of the identification portion has a lower surface roughness value than the surface roughness of the body portion.

13. The coil component of claim 1, wherein the identification portion has a Cu—Ni—Sn three layer structure having a first pattern layer comprising copper (Cu), a second pattern layer comprising nickel (Ni), and a third pattern layer comprising tin (Sn).

14. The coil component of claim 1, further comprising a second insulating layer disposed on one surface of the body, wherein the extension is disposed on the second insulating layer.

15. The coil component of claim 14, wherein the second insulating layer and at least one of the surface of the body is disposed on substantially the same plane.

16. The coil component of claim 1, further comprising a third insulating layer disposed on the wall surface of the body.

17. The coil component of claim 16, wherein the third insulating film includes an insulating resin.

18. A coil component comprising:

a body including a magnetic metal powder;

a coil portion disposed in the body;

an external electrode disposed on one surface of the body and connected to the coil portion, the external electrode including a first electrode layer contacting the body and a second electrode layer disposed on the first electrode layer;

a first insulating layer covering the other surface of the body; and an identification portion passing through the first insulating layer, the identification portion including a first pattern layer including the same material as a material of the first electrode layer and a second pattern layer disposed on the first pattern layer and including the same material as a material of the second electrode layer, wherein each of the first insulating layer and the identification portion has one surface contacting the body and the other surface opposing the one surface, the one surface of the first insulating layer and the one surface of the identification portion are not located on the same plane, and the one surface of the identification layer protrudes into the body more than the one surface of the insulating layer.

* * * * *